US007168495B2

(12) United States Patent
Dallas et al.

(10) Patent No.: US 7,168,495 B2
(45) Date of Patent: Jan. 30, 2007

(54) CASING-ENGAGING WELL TREE ISOLATION TOOL AND METHOD OF USE

(75) Inventors: L. Murray Dallas, Fairview, TX (US); Bob McGuire, Oklahoma City, OK (US)

(73) Assignee: Oil States Energy Services, Inc., Houston, TX (US)

( * ) Notice: Subject to any disclaimer, the term of this patent is extended or adjusted under 35 U.S.C. 154(b) by 340 days.

(21) Appl. No.: 10/813,832

(22) Filed: Mar. 31, 2004

(65) Prior Publication Data

US 2005/0217868 A1 Oct. 6, 2005

(51) Int. Cl.
*E21B 33/068* (2006.01)

(52) U.S. Cl. ..... 166/379; 166/383; 166/90.1

(58) Field of Classification Search ..... 166/379, 166/383, 90.1, 70, 77.4
See application file for complete search history.

(56) References Cited

U.S. PATENT DOCUMENTS

| | | | | |
|---|---|---|---|---|
| 1,997,431 | A | 4/1935 | Penick et al. | 285/22 |
| 2,449,642 | A | 9/1948 | Coons | 166/20 |
| 2,813,589 | A | 11/1957 | Woodruff | 166/225 |
| 3,392,785 | A | 7/1968 | King | 166/196 |
| 4,111,261 | A * | 9/1978 | Oliver | 166/90.1 |
| 4,241,786 | A | 12/1980 | Bullen | 166/77.4 |
| 4,452,304 | A | 6/1984 | Barrier et al. | 166/70 |
| 4,632,183 | A | 12/1986 | McLeod | 166/77 |
| 4,657,075 | A | 4/1987 | McLeod | 166/72 |
| 4,993,489 | A | 2/1991 | McLeod | 166/72 |
| 5,025,857 | A | 6/1991 | McLeod | 166/77.4 |
| 5,285,852 | A * | 2/1994 | McLeod | 166/379 |
| 5,785,121 | A | 7/1998 | Dallas | 166/90.1 |
| 5,819,851 | A | 10/1998 | Dallas | 166/308 |
| 5,975,211 | A * | 11/1999 | Harris | 166/379 |
| 6,220,363 | B1 * | 4/2001 | Dallas | 166/382 |
| 6,234,253 | B1 | 5/2001 | Dallas | 166/377 |
| 6,289,993 | B1 | 9/2001 | Dallas | 166/386 |
| 6,364,024 | B1 | 4/2002 | Dallas | 166/379 |
| 6,447,021 | B1 | 9/2002 | Haynes | 285/302 |
| 6,491,098 | B1 | 12/2002 | Dallas | 166/297 |
| 6,626,245 | B1 | 9/2003 | Dallas | 166/379 |
| 6,712,147 | B2 | 3/2004 | Dallas | 166/379 |
| 6,817,421 | B2 | 11/2004 | Dallas | 166/379 |
| 6,817,423 | B2 | 11/2004 | Dallas | 166/382 |
| 6,820,698 | B2 | 11/2004 | Haynes | 166/381 |
| 6,827,147 | B2 | 12/2004 | Dallas | 166/379 |
| 6,918,439 | B2 | 7/2005 | Dallas | 166/85.3 |
| 6,918,441 | B2 | 7/2005 | Dallas | 166/202 |
| 6,938,696 | B2 | 9/2005 | Dallas | 166/377 |
| 6,948,565 | B2 | 9/2005 | Dallas | 166/382 |
| 7,055,632 | B2 | 6/2006 | Dallas | 175/382 |
| 7,066,269 | B2 | 6/2006 | Dallas et al. | 166/379 |
| 2004/0173347 | A1 * | 9/2004 | Dallas | 166/77.1 |
| 2005/0082066 | A1 | 4/2005 | McGuire et al. | 166/379 |
| 2005/0199389 | A1 | 9/2005 | Dallas et al. | 166/250.07 |
| 2005/0211442 | A1 | 9/2005 | McGuire et al. | 166/379 |

* cited by examiner

*Primary Examiner*—William Neuder
(74) *Attorney, Agent, or Firm*—Nelson Mullins Riley & Scarborough, LLP

(57) ABSTRACT

A casing-engaging wellhead isolation and method of the tool protects wellheads from lifting pressures induced by high fluid pressures and high flow rates used to stimulate low pressure wells. A releasable packer assembly mounted to a bottom end of a mandrel of the tool grips the casing and transfers the lifting pressures directly to the casing. Well treatment safety is thereby significantly enhanced.

26 Claims, 8 Drawing Sheets

CASING-ENGAGING WELL TREE ISOLATION TOOL AND METHOD OF USE

CROSS-REFERENCE TO RELATED APPLICATIONS

This is the first application filed for the present invention.

MICROFICHE APPENDIX

Not Applicable.

TECHNICAL FIELD

The present invention relates in general to well completion and well stimulation procedures and, in particular, to well tree isolation tools used to isolate wellhead components from high fluid pressures used for well stimulation during well completion and re-completion.

BACKGROUND OF THE INVENTION

As is well understood in the art, demand for hydrocarbon fluids continues to steadily increase while supplies and reserves continue to decline. Consequently, many lower-yield reserves are being exploited. Many of those lower-yield reserves produce hydrocarbons at low pressure, especially coal-seam methane wells, shallow oil and gas wells, and the like. Such low pressure wells are commonly produced using low-pressure wellhead equipment such as screwed independent wellhead equipment, well-known in the art. Nonetheless, the completion and/or re-completion of such wells generally requires high pressure stimulation treatments to ensure viable production. Such high pressure stimulation treatments are often performed at high pump rates and high fluid pressures. Although well tree isolation tools are commonly used to isolate wellhead equipment from direct exposure to those fluid pressures. Nonetheless, the well tree isolation tool is mounted to the well tree, and the lifting pressure on the tool resulting from the high pump rates and elevated fluid pressure of the well stimulation fluids can, and has on occasion, over stressed the holding strength of the threaded connection between the casing and the wellhead or a tensile strength of one of the wellhead components. If that connection gives way, workers in the vicinity can be fatally injured by ejected equipment and control of the well is lost, resulting in the escape of hydrocarbons to the atmosphere.

This problem is not exclusive to screwed independent wellheads, however. As is well understood in the art, pump rates and fluid pressures used to stimulate wells equipped with medium pressure flanged wellheads sometimes exceed the tensile strength of the flanged wellhead components. If a tensile strength of a flanged wellhead component is exceeded, rupture can occur resulting in the ejection of equipment from the well, with all of its attendant hazards.

While many different well tree isolation tool configurations and many different pack-off assemblies for those tools are known, there is no known tool that is configured to reduce lift pressure on wellhead components during a well stimulation treatment. Pack-off assemblies for well tree isolation tools seal off against the well casing or tubing to isolate wellhead components from high fluids pressures. Nonetheless, that seal does nothing to control the lift pressure exerted on the wellhead components to which the wellhead isolation tool is mounted.

Consequently, there exists a need for a wellhead isolation tool that not only seals off against the casing but also locks the well tree isolation tool to the casing to transfer lift pressures directly to the casing and thereby ensure that high pressure stimulation can be safely conducted at pressures that exceed the holding and/or tensile strength of wellhead components.

SUMMARY OF THE INVENTION

It is therefore an object of the invention to provide a casing-engaging well tree isolation tool and method of using same that is adapted to protect wellheads during high pressure fluid stimulation treatments to ensure that a lift pressure on wellhead components resulting from well stimulation fluid pressures does not overstress the wellhead components.

The invention therefore provides a casing-engaging wellhead isolation tool that comprises a mandrel that is stroked through the wellhead, and a releasable packer assembly connected to a bottom end of the mandrel. The releasable packer assembly is settable in a set position in which packer slips grip the casing when the wellhead isolation tool is in a set position. The packer assembly transfers lift pressure induced by well stimulation fluids to the casing. Consequently, the well components to which the wellhead isolation tool is mounted are not subjected to lift pressures that could exceed a holding or a tensile strength of any one of the components of the wellhead.

In order to permit the wellhead isolation tool to be stroked through the wellhead of the live well without killing the well, the casing-engaging wellhead isolation tool preferably comprises a setting tool for stroking the mandrel through the wellhead. The wellhead isolation tool further comprises a sealed chamber through which the mandrel is reciprocated. The sealed chamber comprises first and second hallow cylinders. A top portion of the first cylinder is received within a bottom portion of the second cylinder and a fluid seal between the cylinders ensures that the mandrel can be inserted through the wellhead of a live well without an escape of hydrocarbons to atmosphere. The sealed chamber also provides a mechanism for locking the releasable packer assembly in the set position. An outer wall of the first cylinder is threaded and supports a hollow locking flange. A lock nut carried on an annular shoulder of the second cylinder engages the locking flange.

In operation, the setting tool is mounted to the wellhead and a passage through the wellhead is opened. The mandrel with the releasable packer assembly is then stroked through the wellhead and into the casing of the well. The mandrel is secured to a top of the sealed chamber by a threaded union. The releasable packer assembly is set in the casing by pulling up the mandrel to set the slips of releasable packer assembly. The mandrel pulls the second cylinder upwards as the releasable packer assembly is set in the casing. Once the releasable packer assembly is set, the lock flanged is screwed upwardly over the threads in the outer wall of the first cylinder until it abuts a bottom wall of the second cylinder. The locking nut is then threadedly connected to the locking flange to lock the second cylinder in place. The mandrel, is thereby locked in the set position so that the releasable packer assembly cannot be released during a well stimulation operation. After the mandrel is locked in the set position, a wellhead isolation injector tool is removed to provide 360° access to the wellhead isolation tool. In a preferred embodiment, the injection tool comprises a pair of hydraulic cylinders having bottom ends that are releasably connected to support arms affixed to opposite sides of the first cylinder. A top of each hydraulic cylinder is supported by support arms affixed to opposite sides of a mandrel injection adaptor connected by a threaded union to a top of a high pressure valve mounted to a top of the mandrel.

Once locked in the set position, lifting force in the well bore induced by high pressure well stimulation fluids pumped into the well bore is transferred to the casing of the well and does not exert pressure on the wellhead that could exceed a tensile strength of wellhead components.

The invention further provides a method of isolating a wellhead prior to pumping high pressure well stimulation fluids into a casing of a well. The method comprises stroking a mandrel through the wellhead, the mandrel having a bottom end to which a casing packer, is affixed. The method further comprises setting the casing packer in the casing to transfer to the casing lift pressure induced by well stimulation fluids on the mandrel, so that wellhead components to which the wellhead isolation tool is mounted are not subjected to lift pressures that could exceed a tensile strength of components of the wellhead.

The mandrel is preferably stroked through the wellhead using a wellhead isolation setting tool. As described above, the mandrel is stroked through a sealed chamber having an adjustable link and a locking mechanism for locking the mandrel in a set position in which slips of the casing packer engage the casing and transfer lift force induced by high pressure fluids injected into the wellhead to the casing so that wellhead components are not subjected to lift pressures that could exceeds a tensile strength of those components.

In accordance with the method, a top of the sealed chamber is closed by an interchangeable seal adaptor that can be readily changed so that a mandrel sized to optimally fit a casing of a well to be stimulated can be stroked through the wellhead. The interchangeable seal adaptor houses a high-pressure fluid seal that provides a seal around the mandrel and permits the mandrel to be stroked through the wellhead without lost of fluid pressure.

The method and apparatus in accordance with the invention therefore permit hydrocarbon wells equipped with low pressure wellhead components to be stimulated using fluid pressures that approach a burst-strength of a casing of the well. Hydrocarbon production is therefore enhanced without capital investments in durable wellhead components.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

The invention provides a casing-engaging well tree isolation tool that permits wellbores equipped with low pressure wellhead equipment to be stimulated at high fluid pressures without danger of exceeding a tensile or holding strength of any one of the wellhead components. The well tree isolation tool in accordance with the invention includes a mandrel stroked through the wellhead. A bottom end of the mandrel carries a releasable packer assembly that transfers lift pressure induced by high pressure well stimulation fluids directly to a casing of the well.

Figure 1:
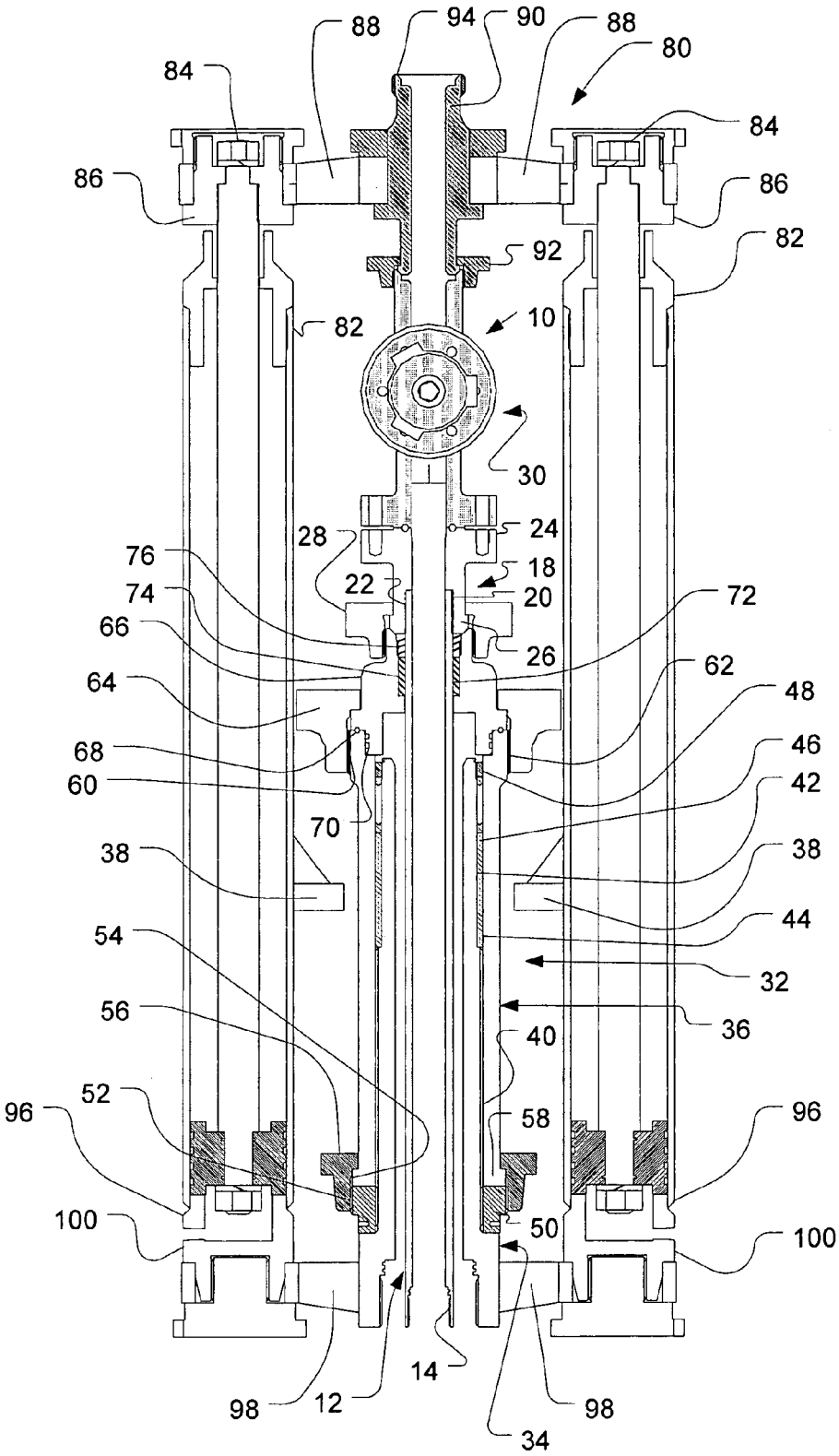
FIG. 1 is a schematic cross-sectional view of an embodiment of a casing-engaging wellhead isolation tool and setting tool in accordance with the invention.

FIG. 1 is a schematic cross sectional view of an embodiment of a casing-engaging wellhead isolation tool 10 in accordance with the invention. The wellhead isolation tool 10 includes a high pressure mandrel 12 having a box-threaded bottom end 14 to which a releasable pack-off assembly 16 (FIG. 2) is connected. The releasable pack off assembly 16 transfers to the casing lift pressures induced by high pressure stimulation fluids injected into the well, as will be explained below in more detail.

A top end of the mandrel 12 is threadedly connected to a mandrel adaptor 18. O-rings 20 provide a fluid seal between a smooth outer surface of a top end of the mandrel 12 and a sealed bore 22 in the mandrel adaptor 18. The mandrel adaptor 18 includes a top flange 24 to which a flow control mechanism, such as a high pressure valve 30 is mounted. The mandrel adaptor 18 further includes an annular shoulder 26 on a bottom end thereof. The annular shoulder 26 rotatably supports a mandrel adaptor lockdown nut 28 used to secure the mandrel adaptor to a top of a sealed chamber 32 through which the mandrel 12 is stroked. The sealed chamber 32 permits a releasable packer assembly 16 shown in FIG. 2 to be locked in a set position, as will be explained below in more detail.

The sealed chamber 32 includes a first cylinder 34 that is connected to a wellhead of a well to be stimulated, as will be explained below in detail, and a second cylinder 36 that reciprocates over an outer surface of the first cylinder 34 within limits defined by travel stops 38. The first cylinder 34 has an outer surface that includes a spiral pin thread 40 on a lower region thereof and a recessed smooth cylinder wall 42 on an upper region thereof. The second cylinder 36 has a smooth inner wall 44, and a high pressure fluid seal 46 captured between the smooth cylindrical wall 42 of the first cylinder and the smooth inner wall 44 of the second cylinder provides a high pressure fluid seal between the first and second cylinders 34,36. The high pressure seal 46 is retained in position by a packing nut 48 in a manner well known in the art.

A hollow lock flange 50 has a box thread that engages the pin thread 40 on the lower region of the first cylinder 34. The lock flange 50 is used to lock the releasable packer assembly 16 shown in FIG. 2 in a set position, as will also be explained below in detail. The lock flange 50 has a pin thread 52 on an outer diameter of a top end thereof. The pin thread 52 is engaged by a box thread 54 of a lock down nut 56 supported on an annular shoulder 58 of a bottom end of the second cylinder 32. A top end of the second cylinder 32 flares outwardly and has a pin-threaded outer surface that is engaged by box thread 62 of a lock down nut 64 used to lock an interchangeable seal adaptor 66 to a top of the second cylinder. A high pressure fluid seal is provided between the second cylinder 36 and the interchangeable seal adaptor 66 by a metal ring gasket for a threaded union 68 and a pair of 0-rings 70, as described in Applicant's Co-pending patent application Ser. No. 10/690,142 filed Oct. 21, 2003 and published on Apr. 21, 2005 under Publication No. US-20050082829-A1 entitled METAL RING GASKET FOR A THREADED UNION, the specification of which is incorporated herein by reference. The interchangeable seal adaptor 66 provides a fluid seal around the periphery of the mandrel 12. The fluid seal is provided by, for example, a chevron packing 72 retained in a packing cavity 74 by a packing nut 76, in a manner well know in the art.

As will be understood by those skilled in the art, the mandrel adaptor 18 and the interchangeable seal adaptor 66 permit the tool to be readily and quickly adapted to an appropriately sized mandrel 12. Since both the mandrel adaptor 18 and the interchangeable seal adaptor 16 are secured to the top of the second cylinder 36 by threaded unions (lockdown nuts 28 and 64) they are readily exchanged, as required to accommodate a different size of mandrel 12. Consequently, prior to performing a well stimulation procedure a mandrel 12 having a diameter best suited to a diameter of the casing 108 is selected. A corresponding mandrel adaptor 18 is also selected, along with a corresponding interchangeable seal adaptor 66. The interchangeable seal adaptor 66 is mounted to the top of the second cylinder 36 and the mandrel 12 is inserted through the high-pressure packing 74 in the top of the interchangeable seal adaptor 66. A top end of the mandrel 12 is then connected to a bottom end of the mandrel adaptor 18 and the tool is ready for service.

During use, the mandrel 12 and of the well isolation tool 10 in accordance with the invention is inserted into a casing or a production tubing of the well and withdrawn from the well by an insertion tool 80. In the illustrated embodiment, the insertion tool 80 includes a pair of hydraulic cylinders 82 supported on their cylinder rods ends 84 by support brackets 86 that are removably affixed to opposed upper support arms 88 connected to a mandrel insertion adaptor 90. The mandrel insertion adaptor 90 is connected to a top of the high pressure valve 30 by a threaded union 92. A top end of the mandrel insertion adaptor includes a bowen union 94 to which a plug or other flow control component can be connected in a manner well known in the art. The cylinder ends 96 of the hydraulic cylinders 82 are removably connected to lower support arms 98 affixed to opposed sides of a bottom end of the first cylinder 34. Quick-release straddle brackets 100 can be quickly released to remove the insertion tool 80 from the wellhead isolation tool 10, as will be explained below in more detail.

Figure 2:
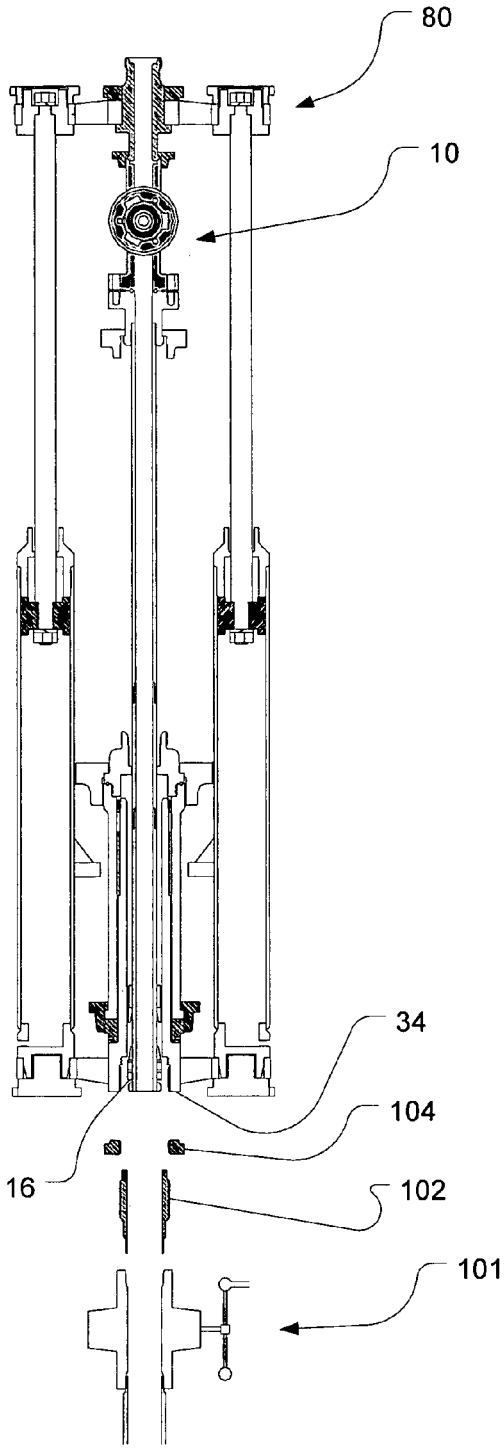
FIG. 2 is a schematic cross-sectional view of the casing-engaging wellhead isolation tool shown in FIG. 1 suspended above a low pressure well that requires stimulation, and further showing an adaptor pin and locking nut used to connect the casing-engaging wellhead isolation tool to the wellhead.
Figure 3:
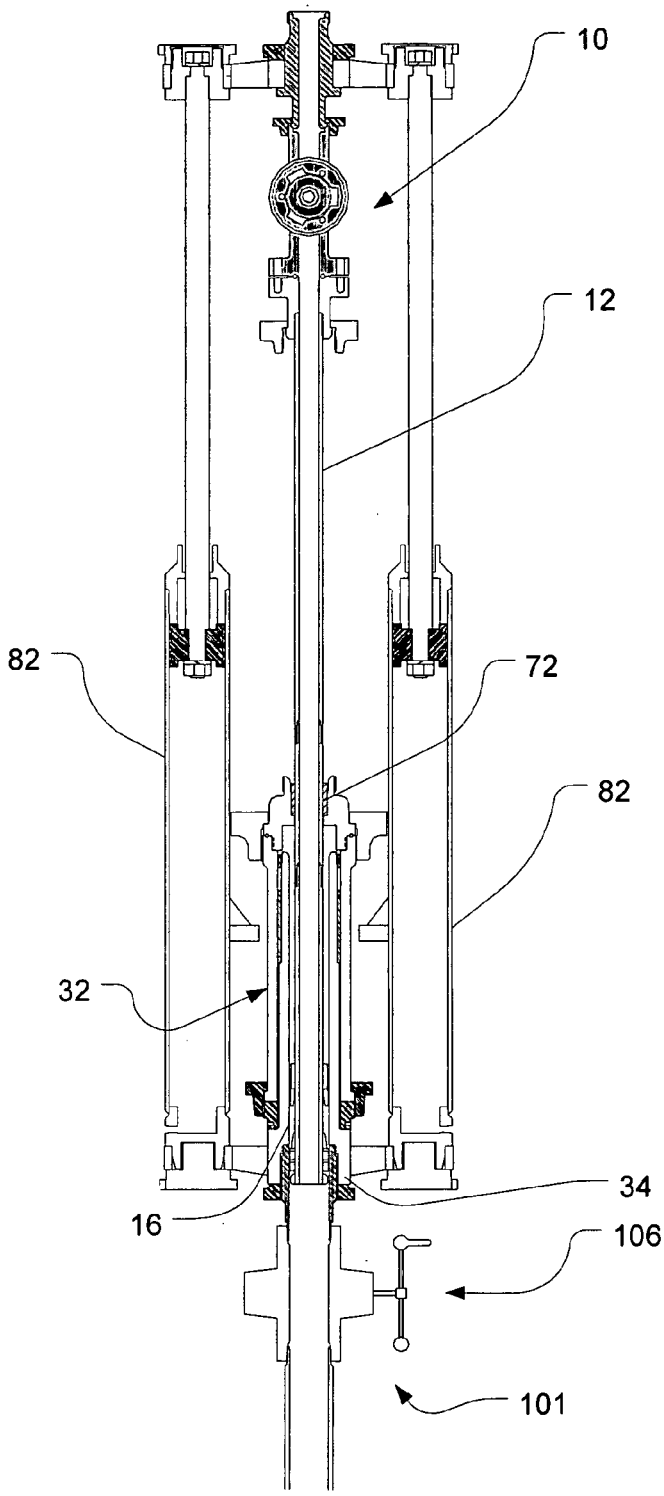
FIG. 3 is a schematic cross-sectional view of the casing-engaging wellhead isolation tool connected to the low pressure wellhead.

FIG. 2 is a schematic cross sectional view of the wellhead isolation tool 10 and the insertion tool 80 suspended over a wellhead 101 by a rig (not shown) or a boom truck (not shown) prior to beginning a well stimulation operation. The wellhead isolation tool is mounted to the wellhead 101 using an adaptor pin 102 and a lock nut 104, as shown in FIG. 3. In order to mount the wellhead isolation tool 10 to the wellhead 101, the adaptor pin 102 is first screwed into a top of the wellhead 101 and the lock nut 104 is threaded over the adaptor pin 102. Wellhead isolation tool 10 is then lowered over a top of the adaptor pin 102 and rotated to threadely secure the wellhead isolation tool 10 to the adaptor pin 102. After a secure connection is achieved, the lock nut 104 is tightened against a bottom of the first cylinder 34 as shown in FIG. 3.

Figure 4:
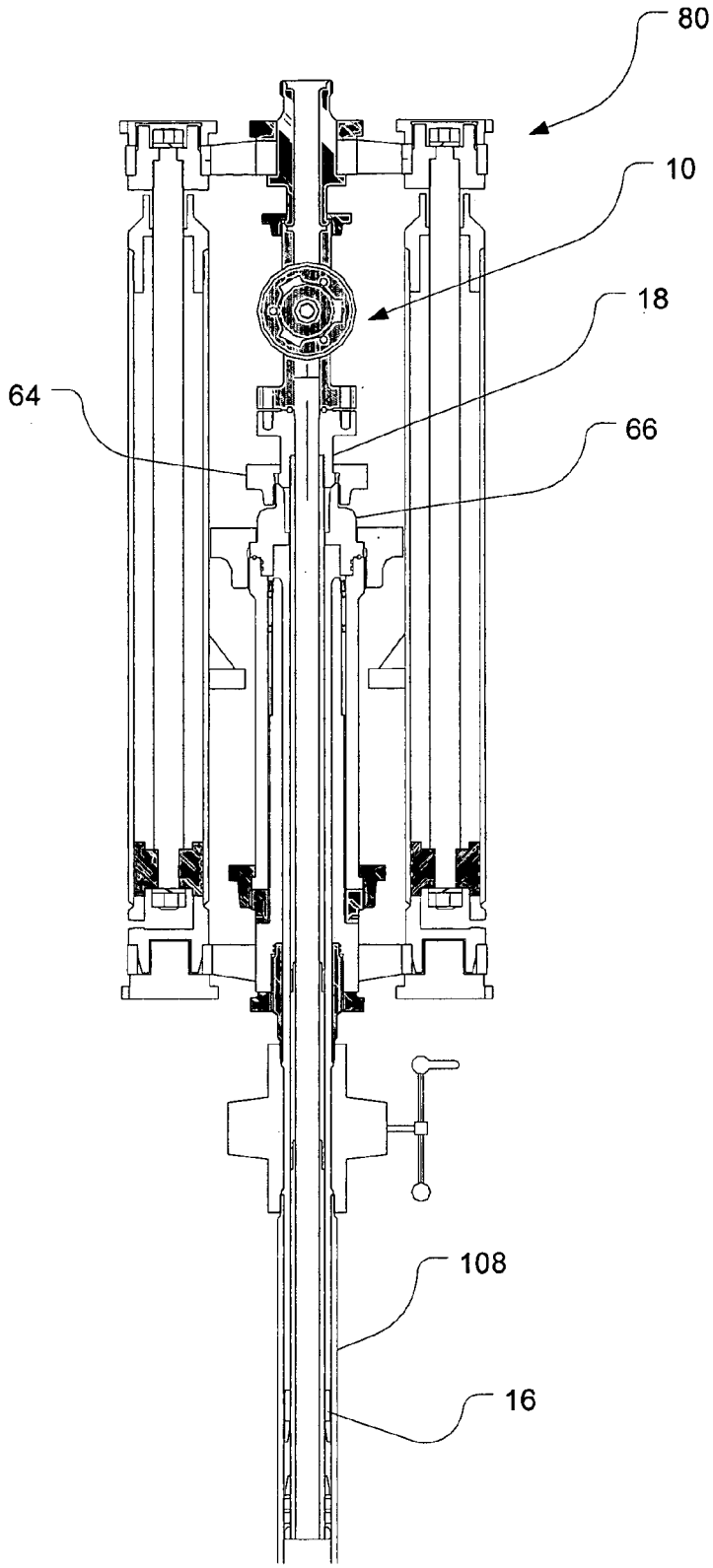
FIG. 4 is a schematic cross-sectional view of the casing-engaging wellhead isolation tool connected to the wellhead with a mandrel of the tool stroked through the wellhead.

As shown in FIG. 3, when the wellhead isolation tool 10 is mounted to the wellhead 101 the hydraulic cylinders 80 are respectively stroked to an extended condition in which the mandrel 12 supports the releasable packer assembly 0.16 in a bottom of the sealed chamber 32 defined by the first and second cylinders 34,36. A master valve 106 on a top of the wellhead 101 is slowly opened to allow well pressure to enter the sealed chamber 32. The well pressure is contained within the sealed chamber 32 by the chevron packing 72 that surrounds the mandrel 12 as explained above with reference to FIG. 1. Once the master valve is fully opened, the hydraulic cylinders 82 are actuated to stroke the mandrel 12 and the releasable packer assembly 16 into the casing of the well as shown in FIG. 4. When the mandrel has been fully stroked through the sealed chamber 32 and the mandrel adaptor 18 rests against a top of the interchangeable seal adaptor 66, the lock down nut 64 is rotated to lock the mandrel adaptor 18 to the interchangeable seal adaptor 66 as shown in FIG. 4, and the releasable packer assembly 16 is ready to be set in the casing 108 of the well.

Figure 5:
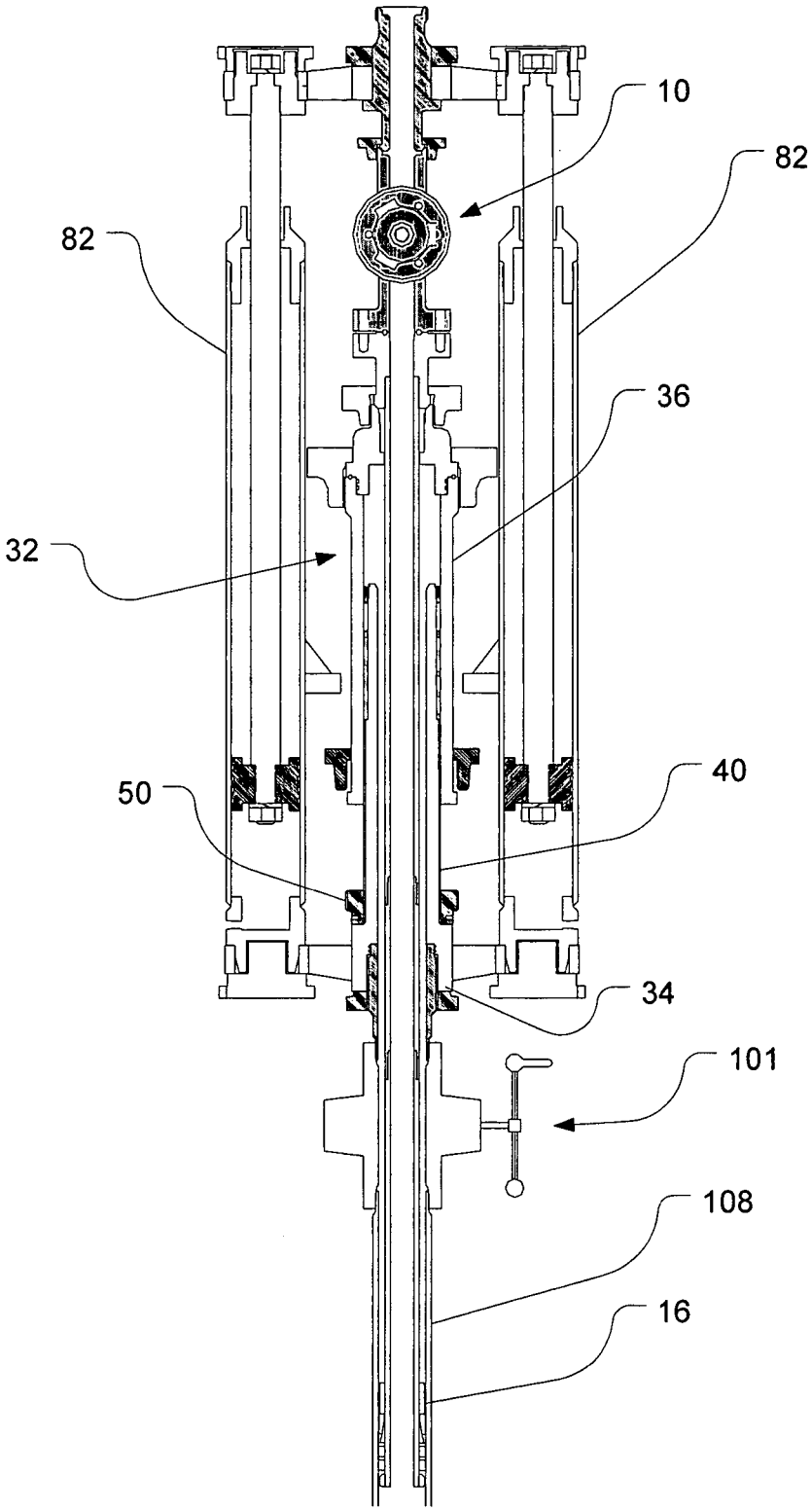
FIG. 5 is a schematic cross-sectional view of the casing-engaging wellhead isolation tool with the mandrel pulled up to a set position in which a releasable packer assembly of the wellhead isolation tool is set in the casing.

FIG. 5 shows the wellhead isolation tool 10 in a set position in which the hydraulic cylinders 82 have been actuated to raise the wellhead isolation tool 10 from the fully stroked-in position. This causes the releasable packer assembly 16' to "set". As is well understood in the art, once a releasable packer assembly 16 is set, internal mechanisms of the releasable packer assembly 16 cause casing-gripping slips to be forced outwardly into contact with the casing. As upward pressure increases, the slips bite into the interior of the casing to create a positive lock that can only be released by manipulating the releasable packer assembly 16 as required by the manufacturer. In one embodiment of the invention, the releasable packer assembly 16 is a "yo-yo" packer assembly well known in the art that has been specially modified to have a shorter length than prior art releasable packer assemblies of the same type. However, any of dozens of releasable packer assemblies well known in the art and available, for example, from Otis Engineering Corporation; Arrow Oil Tools; Team Oil Tools and other manufactures can be used for the same purpose.

Figure 6:
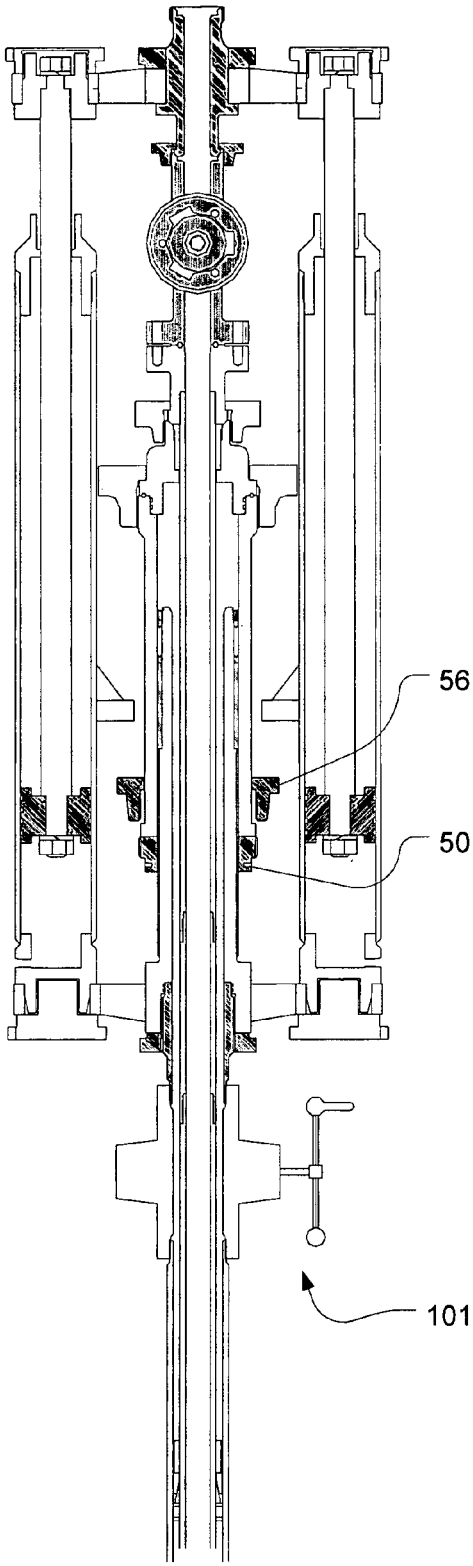
FIG. 6 is a schematic cross-sectional view of the casing-engaging wellhead isolation tool showing a lock flange locking a second cylinder of a sealed chamber through which the mandrel is reciprocated, to ensure that the releasable packer assembly is locked in the set position.

By the time that the releasable packer assembly 16 is set as shown in FIG. 5, the second cylinder 36 of the sealed chamber 32 has been drawn upwardly over pin-threaded lower region of the first cylinder 34. The hydraulic cylinders 82 are then locked in position while the lock flange 50 is rotated upwardly until it abuts the bottom end of the second hydraulic cylinder 36 as shown in FIG. 6. Thereafter, the lock down nut 56 is rotated to threadedly engage the lock flange 50 to lock the second cylinder 36 in the set position. Consequently, the releasable packer assembly 16 is locked in the set position and cannot be released from that position. This ensures that once set, the releasable packer assembly 16 cannot be unset until the well stimulation procedure is complete. After the second cylinder 36 is locked in the set position by the lock flange 50 and the lock-down nut 56 shown in FIG. 7, quick release brackets 100 are released to release the hydraulic cylinders 82 from the lower support arms 98. Concurrently, the threaded union 92 is rotated to disconnect the mandrel insertion adaptor 90 from the high pressure valve 30 and the insertion tool 80 is hoisted away from the wellhead insertion tool as shown in FIG. 8.

Figure 8:
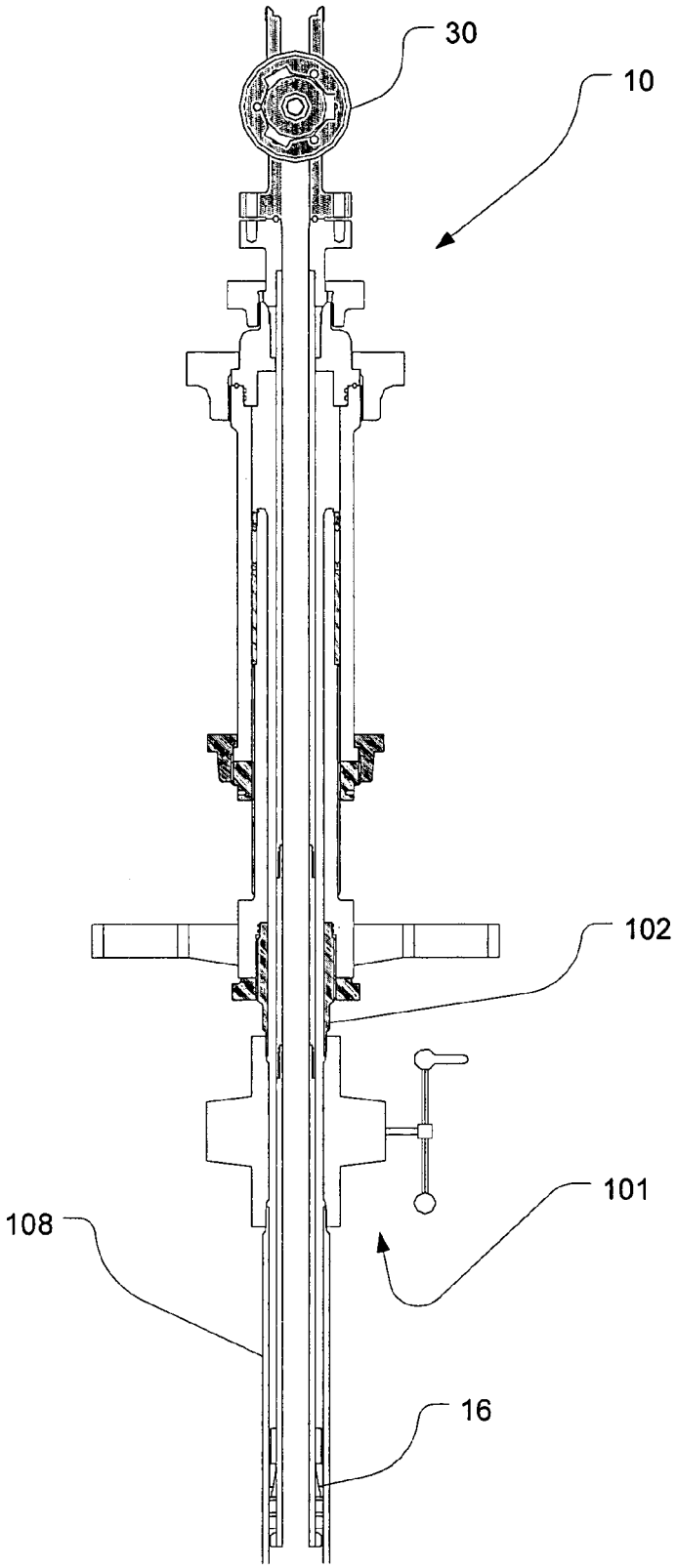
FIG. 8 is a cross-sectional schematic view of wellhead isolation tool in accordance with the invention in a position ready for the injection of high pressure stimulation fluids into the casing of the well It will be noted that throughout the appended drawings, like features are identified by like reference numerals.

FIG. 8 shows the wellhead insertion tool in a set position in which the releasable packer assembly 16 securely grips the inside wall of the well casing 108, as described above. A high pressure line (not shown) is then connected to a top of the high pressure valve 30 in a manner well known in the art. High pressure stimulation fluids are pumped through the wellhead isolation tool. As is well known, high fluid pressures and high flow rates are required for stimulating a hydrocarbon production formation with which the casing 108 communicates. Those high pressure fluids exert considerable lift pressure on the wellhead isolation tool 10. However, because the releasable packer assembly 16 is in the set position and the wellhead 101 is compressed between the adaptor pin 102 and the casing 108, the components of wellhead 101 are not subject to lift pressures exerted on the wellhead isolation tool 10. Any risk of exceeding a tensile strength of components of wellhead 101 is therefore eliminated.

Figure 7:
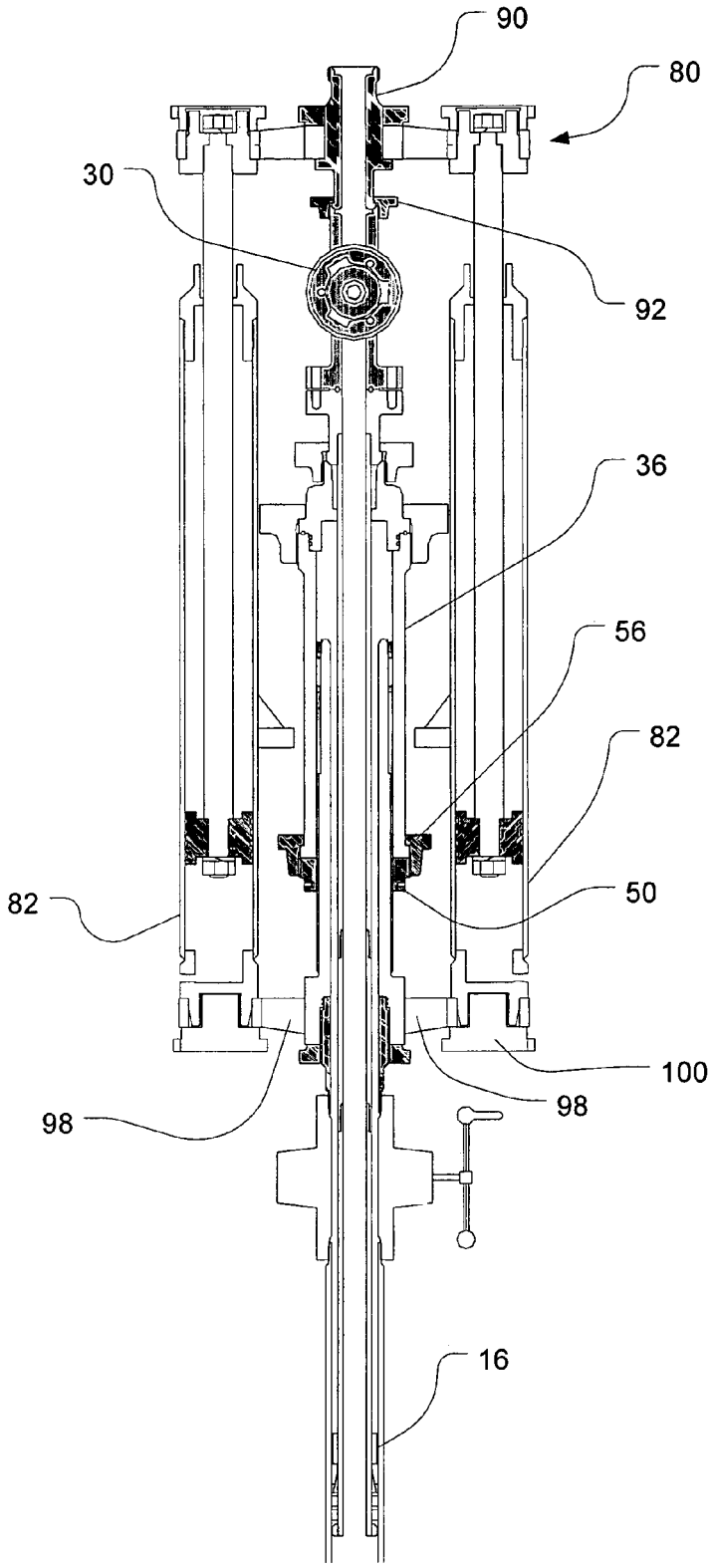
FIG. 7 is a schematic cross-sectional view of the wellhead isolation tool shown in FIG. 6 with a lock nut engaging a pin thread on a top of the lock flange.

After the well stimulation treatment is completed, the insertion tool 80 is re-mounted on the wellhead isolation tool 10, as shown in FIG. 7, and the above-described procedure is followed in reverse order to remove the tool from the wellhead. As will be understood by those skilled in the art, certain pressure balancing and pressure relief steps required for safe operation have not been described but are well known in the art.

Although the wellhead isolation tool 10 in accordance with the invention is primarily intended for use in stimulating low pressure wells where wellhead equipment is not of a quality adapted to resist lift pressures exerted by the high volume injection of high pressure well stimulation fluids, the wellhead isolation tool in accordance with the invention can be used for stimulating any well to ensure that an integrity of the wellhead components is not compromised.

Although the invention has been described above with reference to an explicit embodiment, it should be understood that the invention can be applied to any wellhead isolation tool inserted into a well casing and that any releasable casing-engaging mechanism adapted to transfer lift pressures directly to the casing in order to isolate the wellhead components from exposure to the lift pressures may be used in a wellhead isolation tool in accordance with the invention. It should also be understood that the mandrel 12 can be inserted using any known insertion tool, and the insertion tool 80 described above is only exemplary of an insertion tool that could be used.

The embodiments of the invention described above are therefore intended to be exemplary only and the scope of the invention is limited only by the scope of the appended claims.

We claim:

1. A casing-engaging wellhead isolation tool for isolating a wellhead of a cased well from high pressure well stimulation fluids, comprising:

a mandrel that is stroked through the wellhead; and a releasable packer assembly connected to a bottom end of the mandrel, the releasable packer assembly being settable in a set position in which internal mechanisms of the releasable packer assembly cause casing-gripping slips to be forced outwardly into contact with a well casing so that the packer slips grip the casing after the wellhead isolation tool is stroked through the wellhead to a set position, to transfer lift pressure induced by well stimulation fluids to a casing of the cased well, so that wellhead components to which the wellhead isolation tool is mounted are not subjected to lift pressures that could exceed a holding or tensile strength of any component of the wellhead.

2. The casing-engaging wellhead isolation tool as claimed in claim 1 further comprising a setting tool for stroking the mandrel through the wellhead.

3. The casing-engaging wellhead isolation tool as claimed in claim 2 wherein the wellhead isolation tool comprises a sealed chamber through which the mandrel reciprocates, the sealed chamber having an adjustable length to permit the mandrel to be locked in the set position of the wellhead isolation tool.

4. The casing-engaging wellhead isolation tool as claimed in claim 3 wherein the sealed chamber comprises:

a first hollow cylinder having a bottom end that is mounted to a top of the wellhead and an open top end;

a second hollow cylinder having an open bottom end that receives the top end of the first cylinder and a closed top end that houses a high-pressure packing through which the mandrel reciprocates; and a high-pressure fluid seal disposed between an inner wall of the second cylinder and an outer wall of the first cylinder, the high pressure fluid seal permitting the second cylinder to be moved upwardly and downwardly over the first cylinder within predetermined upper and lower limits without loss of fluid containment within the sealed chamber.

5. The casing-engaging wellhead isolation tool as claimed in claim 4 wherein the outer wall of the first cylinder further comprises a smooth cylindrical upper region which the high-pressure fluid seal contacts and a spiral-threaded lower region having an elongated pin thread engaged by a box thread of a hollow lock flange disposed on the lower region of the first cylinder.

6. The casing-engaging wellhead isolation tool as claimed in claim 5 wherein an outer wall of the second cylinder further comprises an annular shoulder on a bottom end thereof, the annular shoulder supporting a lockdown nut having a box thread that engages a pin thread on an outer surface of the hollow lock flange disposed on the lower region of the first cylinder.

7. The casing-engaging wellhead isolation tool as claimed in claim 6 wherein the top end of the second cylinder comprises an interchangeable seal adaptor that is secured to a top end of the outer wall of the second cylinder, the interchangeable seal adaptor housing the high-pressure packing through which the mandrel reciprocates, to permit selection of a mandrel having a diameter best suited to a diameter of a casing of a well to be stimulated using the wellhead isolation tool.

8. The casing-engaging wellhead isolation tool as claimed in claim 7 wherein the interchangeable seal adaptor is secured to the second cylinder by a threaded union.

9. The casing-engaging wellhead isolation tool as claimed in claim 8 wherein the interchangeable seal adaptor further comprises a pin-threaded annular top end that is engaged by a box-threaded lockdown nut supported by an annular flange on a bottom end of a mandrel adaptor mounted to a top end of the mandrel, the last-mentioned lockdown nut removably locking a mandrel adaptor to the top of the sealed chamber.

10. The casing-engaging wellhead isolation tool as claimed in claim 9 wherein the mandrel adaptor further comprises a top flange to which a high pressure valve is mounted to control fluid flow through the mandrel.

11. The casing-engaging wellhead isolation tool as claimed in claim 10 further comprising a mandrel insertion adaptor connected to a top of the high pressure valve.

12. The casing-engaging wellhead isolation tool as claimed in claim 11 further comprising first and second hydraulic cylinders for reciprocating the mandrel, the first and second hydraulic cylinders being respectively connected on one end to support arms on opposed sides of the mandrel insertion adaptor, and respectively connected on an opposite end to support arms affixed to opposed sides of a bottom end of the first cylinder.

13. The casing-engaging wellhead isolation tool as claimed in claim 12 wherein cylinder ends of the hydraulic cylinders are removably connected to the support arms affixed to opposed sides of a bottom end of the first cylinder.

14. The casing-engaging wellhead isolation tool as claimed in claim 13 further comprising an adaptor pin for connecting the wellhead isolation tool to a top of the wellhead, the adaptor pin having pin-threaded top and bottom ends, the pin-threaded top end being adapted to engage a box thread in a bottom end of the first cylinder and the pin-threaded bottom end being adapted to engage a box thread in a top end of the wellhead.

15. A method of isolating a wellhead prior to pumping high pressure well stimulation fluids into a casing of a well, comprising:

stroking a mandrel through the wellhead, the mandrel having a bottom end to which a casing packer is affixed; and setting the casing packer in the casing by activating internal mechanisms of the casing packer to cause casing-gripping slips to be forced outwardly into contact with the casing to transfer to the casing lift pressure induced by well stimulation fluids on the mandrel, so that wellhead components to which a wellhead isolation tool is mounted are not subjected to lift pressures that exceed a tensile strength of any component of the wellhead.

16. The method as claimed in claim 15 wherein the step of stroking the mandrel through the wellhead comprises:

mounting the wellhead isolation tool to the wellhead, wherein the wellhead isolation tool comprises a setting tool for stroking the mandrel through the wellhead.

17. The method as claimed in claim 16 further comprising stroking the mandrel through a sealed chamber having an adjustable length to permit the mandrel to be locked in a set position in which the casing packer is set.

18. The method as claimed in claim 17 further comprising:

locking a top end of the mandrel to a top end of the sealed chamber after the casing packer is stroked into the casing; and applying lifting pressure to the mandrel to move the mandrel and a second cylinder of the sealed chamber upwardly to the set position in which the casing packer is set in the casing.

19. The method as claimed in claim 18 further comprising:

rotating a hollow lock flange disposed on a pin-threaded lower region of a first cylinder of the sealed chamber to move the lock flange upward into contact with a bottom end of the second cylinder; and rotating a lockdown nut having a box thread that engages a pin thread on an outer surface of the lock flange, the lockdown nut being supported by an annular flange on a bottom end of the second cylinder to lock the second cylinder and the mandrel in the set position.

20. The method as claimed in claim 19 wherein prior to stroking the mandrel through the wellhead, the method comprises:

selecting a mandrel having a diameter best suited to a diameter of the casing;

selecting a corresponding mandrel adaptor;

selecting a corresponding interchangeable seal adaptor and mounting the interchangeable seal adaptor to a top end of the second cylinder;

inserting the mandrel through a high-pressure packing in a top of the interchangeable seal adaptor; and connecting a top end of the mandrel to a bottom end of the mandrel adaptor.

21. The method as claimed in claim 20 further comprising securing the mandrel adaptor to the top end of the second cylinder using a threaded union.

22. The method as claimed in claim 21 further comprising mounting a high pressure valve to a top of the mandrel adaptor to control fluid flow through the mandrel.

23. The method as claimed in claim 22 further comprising mounting a mandrel insertion adaptor to a top of the high pressure valve.

24. The method as claimed in claim 23 further comprising connecting first and second hydraulic cylinders for reciprocating the mandrel to support arms affixed to opposite sides of the mandrel insertion adaptor and to opposite sides of a bottom end of the first cylinder.

25. The method as claimed in claim 24 further comprising removing the hydraulic cylinders and the mandrel insertion adaptor from the wellhead isolation tool after the mandrel is locked in the set position.

26. The method as claimed in claim 25 further comprising installing an adaptor pin to connect the wellhead isolation tool to a top of the wellhead, the adaptor pin having pin-threaded top and bottom ends, the pin-threaded top end being adapted to engage a box thread in a bottom end of the first cylinder and the pin-threaded bottom end being adapted to engage a box thread in a top end of the wellhead.

* * * * *